United States Patent [19]

Terao et al.

[11] Patent Number: 4,707,428

[45] Date of Patent: Nov. 17, 1987

[54] ELECTROSTATIC LATENT IMAGE DEVELOPING METHOD

[75] Inventors: Kazuo Terao; Tsutomu Kubo; Nobuo Hyakutake; Hidekiyo Tachibana; Jun-ichi Hama; Touru Teshigawara; Masashi Kajimoto, all of Ebina, Japan

[73] Assignee: Fuji Xerox Co., Ltd., Tokyo, Japan

[21] Appl. No.: 918,650

[22] Filed: Oct. 14, 1986

Related U.S. Application Data

[63] Continuation of Ser. No. 688,383, Jan. 2, 1985, abandoned.

[30] Foreign Application Priority Data

May 31, 1984 [JP] Japan ..... 59-109737

[51] Int. Cl.[4] ..... G03G 13/22

[52] U.S. Cl. ..... 430/102; 430/103

[58] Field of Search ..... 430/102, 103, 122

[56] References Cited

U.S. PATENT DOCUMENTS

| | | | |
|---|---|---|---|
| 3,866,574 | 2/1975 | Hardennrook et al. | 355/3 DD |
| 3,890,929 | 6/1975 | Walkup | 355/3 DD |
| 3,893,418 | 7/1975 | Liebman et al. | 355/3 DD |
| 4,076,857 | 2/1978 | Kasper et al. | 430/122 X |
| 4,265,197 | 5/1981 | Toyono et al. | 430/103 X |
| 4,292,387 | 9/1981 | Kanbe et al. | 430/102 |
| 4,444,864 | 4/1984 | Takahashi | 430/122 X |
| 4,447,517 | 5/1984 | Yuge et al. | 430/122 |

*Primary Examiner*—Roland E. Martin

*Attorney, Agent, or Firm*—Armstrong, Nikaido, Marmelstein & Kubovcik

[57] ABSTRACT

A developing method comprising disposing an electrostatic latent image holding body and a development electrode carrying a toner layer opposite to each other with a gap therebetween and transferring the toner from the development electrode to the electrostatic latent image holding body across the gap to develop the electrostatic latent image. A toner carrying layer of a resistive material having the specific resistance of $10^6$ to $10^{12}$ Ω.cm is formed over the development electrode opposite to the electrostatic latent image holding body and a fringing field is formed in part of the electrostatic latent image holding body corresponding to the latent image formed over the electrostatic latent image holding body by applying a high-frequency alternating electric field to the development electrode and thereby causing the toner adhere to the electrostatic latent image holding body in the form of the electrostatic latent image.

5 Claims, 10 Drawing Figures

ELECTROSTATIC LATENT IMAGE DEVELOPING METHOD

This application is a continuation of application Ser. No. 688,383 filed Jan. 2, 1985, now abandoned.

BACKGROUND OF THE INVENTION

1. Field of the Invention

The present invention relates to a developing method for visualizing an electrostatic latent image and more specifically to a developing method using a single-component developer capable of forming a dot copy of excellent tone gradation and a line copy of excellent sharpness and of high fidelity reproduction of solid blacks.

2. Description of the Prior Art

According to the electrophotography disclosed in U.S. Pat. No. 2,297,791 of Carlson, a photosensitive body having a photoconductive layer is charged uniformly, an electrostatic latent image is formed over the photosensitive body by an image exposure, the electrostatic latent image is visualized, i.e., developed, by using a substance such as a charged powder, and then the visualized image is transferred and fixed to a sheet. The cascade developing process, the magnetic bursh developing process and the liquid developing process are well-known processes applicable to developing the electrostatic latent image in the above-mentioned electrophotography. U.S. Pat. No. 2,895,847 discloses another important developing method, namely, a transfer developing method using a toner carrying member called as "a donor". The transfer developing method disclosed in the above patent is the general designation of (1) a developing method in which the toner layer and the photosensitive body are disposed with a gap therebetween and the toner flies across the gap, (2) a developing method in which the toner layer and the photosensitive body are disposed in rotary contact with each other and (3) a developing method in which the toner layer and the photosensitive body are disposed in sliding contact with each other, and this transfer developing method is well-known also as "the touch down developing method".

However, the transfer developing method has a serious problem, a problem of fogging in the background. U.S. Pat. No. 2,839,400 proposed a noncontact transfer developing method to improve the fogging. However, to make a toner fly across the gap between a photosensitive body and a donor as proposed in said patent, the width of the gap needs to be 0.05 mm or less or, if possible 0.03 mm or less, which is quite difficult in respect of the mechanical accuracy of the photosensitive body and the donor. In order to solve such a problem, U.S. Pat. Nos. 3,866,574, 3,890,929 and 3,893,418 disclosed methods in which an alternating electric field is formed between the photosensitive body and the donor. In U.S. Pat. No. 3,866,574 in particular, the relation between the developing gap and the alternating electric field is described. According to the same U.S. Patent, the conditions of the developing gap $D_g$, the amplitude of the alternating electric field $V_{p-p}$ and the frequency f of the alternating electric field for the most satisfactory line development and the least fogging in the background are those meeting: 0.05 mm$\leqq D_g \leqq$0.18 mm, 1.5 kHz$\leqq f \leqq$10 kHz and $V_{p-p} \leqq$800 V.

As regards the charge of the toner, even if the toner is manufactured and prepared in accordance with a fixed recipe, the charges of toner particles distributes in a distribution due to the dispersion of the particle size and the dispersion of the individual toner particles in physical properties, however, the charges distribute about a fixed value within a narrow range. Accordingly, the noncontact transfer developing method disclosed in U.S. Pat. No. 3,866,574 has a threshold for the toner to fly across the developing gap (designated as "flying threshold" hereinafter) in surface potential, and hence toner adheres to a surface of a surface potential greater than the flying threshold, whereas toner does not adhere to a surface of a surface potential smaller than the flying threshold. Thus, this noncontact transfer development method has a critical developing characteristic and produces a copy of extremely high $\gamma$ ($\gamma$=the gradient of a characteristic curve of copy density relative to the potential of electrostatic image) and insufficient tone gradation. Furthermore, even if the charges of toner particles distributes over a wide range, only some of the toner particles can fly when the amplitude $V_{p-p}$ of the alternating electric field is 800 V or below and a copy of high $\gamma$ value results.

Japanese Patent publication No. Sho 58-32375 discloses a developing method to improve the critical developing characteristics dominated by the flying threshold restricting the flying of toner, namely developing characteristic represented by a large value of $\gamma$ and incapable of developing a latent image of satisfactory tone gradation. The invention disclosed in the Japanese patent publication is characterized by applying an alternating electric field to the developing gap in order to cause the alternate repetition of the transfer of the toner from a toner carrying body to a photosensitive body and the reverse transfer of the toner from the photosensitive body to the toner carrying body. In the specification of said patent, it is described that the alternate repetition of the transfer and the reverse transfer of the toner is scarecely effective when the frequency of the applied vias voltage is 2 kHz or above and is quite effective when 1 kHz or below.

This developing method in which a low-frequency alternating electric field is applied to the developing gap, is deemed to be effective in respect of causing the faithful adherence of the toner according to the surface potential when the charges of toner particles distribute within a narrow range and the flying of the toner across the developing gap is restricted by a definite threshold.

However, in case of the noncontact transfer developing process, if the electrostatic latent image has a high frequency, lines of electric force are not decomposed on the toner carrying body when the developing gap is 0.1 mm or above, and thereby the same electric field is formed over the image section and the nonimage section, that is, an image or picture formed by extremely fine lines or dots is blurred and becomes indistinct. This phenomenon will be described in detail hereunder. In the description, the degree of "indistinctness" is represented by an index M defined by a formula $$M=(1-10^{-\Delta D})/(1+10^{-\Delta D})$$

where $\Delta D$ is the density difference between the image section and the nonimage section. FIG. 1 is a graph showing the dependence of M on space frequency. From this, it is known that picture elements can be resolved to a density of about 5 l.p(line pair)/mm, but when the density is 6 l.p/mm or greater the image section and the nonimage section cannot be discriminated at all. Furtheremore, it was found through the microscopic observation of a copy image that the reduction of M was attributable to the blur of the developed image.

On the other hand, this method has the developing characteristics for dot-copies as shown in FIG. 2. When the line density is 65 line/in. or above., the image section becomes indistinct and the range of the developed image disagrees with the range of the image input. Consequently, the developed image of a dot-copy of high line density generally becomes dark and indistinct with insufficient contrast in the details, which is a serious problem. In order to solve this problem, a low-frequency alternating electric field was applied to the developing gap according to the method disclosed in the above-mentioned Japanese Patent Publication No. Sho 58-32375. This method surely improves the tone reproduction characteristics, and thereby the latent image is developed comparatively faithfully according to the surface potential of the photosensitive body. However, it was also found that this method was effective for pictures or images of 65 line/in. or less line density and not effective for pictures of higher line density.

The ineffectiveness of the application of the low-frequency alternating electric field is reasoned that the indistinctness of the picture of a high-density dot copy is not due to the critical developing characteristics of high $\gamma$ owing to the flying threshold, but is due to a fact that the electric field corresponding to the electrostatic latent image is not faithful to the electrostatic latent image, and hence image section and the nonimage section on the toner carrying body are not different from each other in electric field, that is, the image section and the nonimage section are not contrasted in respect of electric field.

Furthermore, if the resistance and the thickness of the toner carrying body is not appropriate, for instance, when an ordinary metallic sleeve is employed, any reverse electric field is not produced even in the vicinity (10 to 20 $\mu$m) of the photosensitive body. Consequently, the toner flying without discrimination of the image section and the nonimage section gains kinetic energy in the developing gap and does not fly faithfully along the lines of electric force, so that the toner adheres to the nonimage section as well.

In the conventional noncontact transfer developing method, the above-mentioned two problems, i.e., (1) the deficiency in the electric field produced over the toner carrying body according to the electrostatic latent image between the image section and the nonimage section and (2) the deviation of the flying toner from the line of electric force were the causes of the indistinctness of the image section of a high line density and insufficient power of resolution, namely, the causes of deficiency in minute and faithful reproduction.

SUMMARY OF THE INVENTION

It is, therefore, an object of the present invention to provide an electrostatic latent image developing method which can overcome the problems of the above-mentioned various noncontact developing method of the prior art.

Another object of the present invetion is to provide an electrostatic latent image developing method which is excellent in dot-copy reproduction characteristics and detail reproduction characteristics without deteriorating line-copy and solid blacks reproductions and other characteristics of the reproduced image.

In accordance with an aspect of the present invention, there is provided a developing method comprising disposing an electrostatic latent image holding body and a development electrode carrying a toner layer opposite to each other with a gap therebetween and transferring the toner from the development electrode to the electrostatic latent image holding body accross the gap to develop the electrostatic latent image, characterized in that a toner carrying layer of a resistive material is formed over the development electrode opposite to the electrostatic latent image holding body and a fringing field is formed in part of the electrostatic latent image holding body corresponding to the latent image formed over the elctrostatic latent image holding body by applying a high-frequency alternating electric field to the development electrode and thereby causing the toner adhere to the electrostatic latent image holding body in the form of the electrostatic latent image.

It is a first feature of the present invention to produce a fringing field around the electrostatic latent image to provide dot-copy faithful reproduction characteristics and line-copy faithful reproduction characteristics. When the gap between the development electrode and the photosensitive body is minute (0.1 to 0.5 mm), a fringing field cannot be produced or produced scarcely, therefore, the development electrode and the photosensitive body need to be separated by a sufficient distance. However, if the development electrode is disposed simply away from the photosensitive body, discharge occurs between the development electrode and the photosensitive body and since the kinetic energy of the flying toner increases, and hence the toner does not fly along the line of electric force and the toner adheres to the nonimage section, a layer of a resistive material is formed over the development electrode to provide a sufficient distance between the development electrode and the photosensitive body and to make the distance between the toner and the photosensitive body minute so that a fringing field is formed around the electrostatic latent image. Preferably, the specific resistance of the resistive layer formed over the development electrode is $10^6$ to $10^{12}$ $\Omega$.cm, because if the resistive layer is highly conductive, the fringing field cannot be produced and if the resistive layer is highly insulating, the voltage contrast in the central portion of the image is reduced to decrease the density of the central portion of the image.

It is a second feature of the present invention to apply a high-frequency alternating electric field to the development electrode to promote the transfer of the toner across the gap between the development electrode and the photosensitive body as increase in the distance between the development electrode and the photosensitive body makes the transfer of the toner across the gap difficult. Preferably, the high-frequency alternating electric field is of 1 to 10 kHz frequency and 400 to 4500 V amplitude. More preferably, the high-frequency alternating electric field is of 1 to 3 kHz frequency and 800 to 2500 V amplitude.

It is a third feature of the present invention to expand the range of distribution of charges of toner particles. Charges of the particles of a conventional single-component developer distribute within a comparatively narrow range. Accordingly, there was a definite flying threshold when such a single-component developer was used for noncontact transfer development, and thereby the noncontact transfer developing process was affected by critical developing charcteristics. According to the present invention, the range of distribution of the charge of the toner is expanded to obscure the flying threshold so that the tone gradation reproducibility is improved. The preferable range of distribution of the charge of a toner is ±0.15 μc/g with respect to the median.

The above and other objects, features and advantages of the present invention will become readily apparent from the following description taken in conjunction with the accompanying drawings.

DETAILED DESCRIPTION OF THE INVENTION

Figure 1:
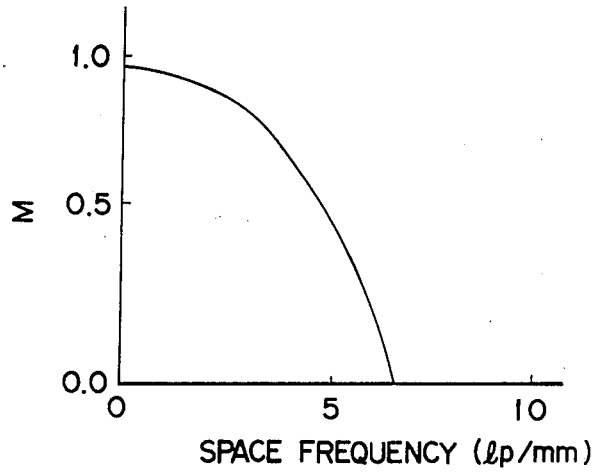
FIG. 1 is a graph showing the dependence of the index M of "indistinctness" of the image on space frequency.
Figure 2:
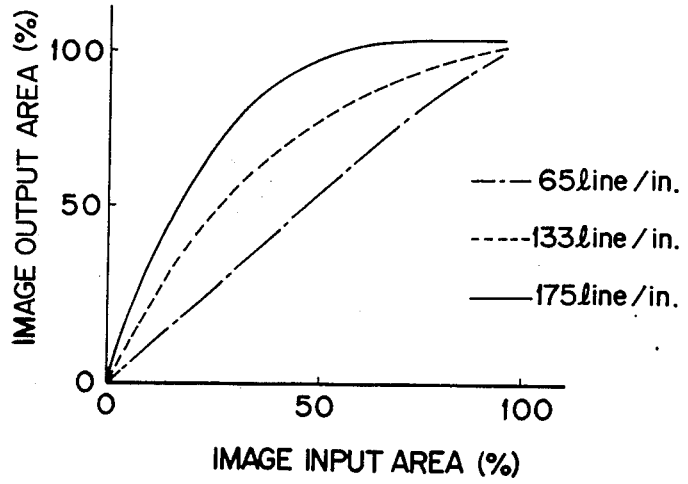
FIG. 2 is a graph showing the variation of image output area with image input area for line densities.
Figure 3:
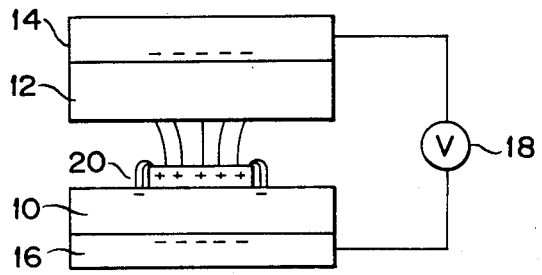
FIG. 3 is a schematic illustration showing the disposition of a photosensitive body and a toner carrying body, according to the present invention.

The invention will be described in detail hereinafter with reference to the accompanying drawings. First, forming a fringing field around an electrostatic latent image will be described in connection with FIG. 3. A photosensitive body 10 and a toner carrying layer 12 formed of a layer of a resistive material are disposed opposite to each other. A high-frequency alternating electric field is applied between a development electrode 14 and a conductive substrate 16 of the photosensitive body by a power source 18. In the constitution shown in FIG. 3, a fringing field 20 is formed around an electrostatic latent image formed on the photosensitive body by controlling an electric field produced by the electrostatic latent image by means of the resistance, thickness and dielectic constant of the toner carrying layer 12 and the gap between the photosensitive body 10 and the toner carrying layer 12 to reproduce a dot-copy and/or a line-copy minutely and faithfully. The effects of control factors relevant to such minute and faithful reproduction will be described hereunder.

Figure 4:
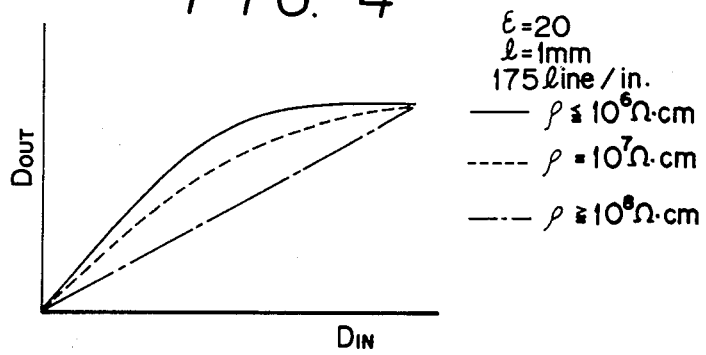
FIG. 4 is a graph showing dot-copy reproducibility for various specific resistances of the toner carrying layer.

FIG. 4 shows reproducibility for a dot-copy 175 line/in, in which the axis of abscissa represents original densit $D_{IN}$ and the axis of ordinate represents copy density $D_{OUT}$. It is desirable that the image reproducing characteristic is expressed by a straight line with a gradient of 1. The image reproducing characteristic will be described in connection with FIG. 4 for a toner carrying body 12 with a thickness $l=1$ mm and specific inductive capacity $\epsilon=20$. When the specific resistance $\rho$ of the toner carrying layer 12 is $10^6\Omega$.cm or below, the slope of the curve decreases as $D_{IN}$ increases, and thereby the image or picture section becomes indistinct and so-called "dark" picture is produced. When $\rho$ is $10^7$ Ω.cm, the image reproducibility curve is relatively linear and the gradient is nearly 1. When $\rho$ is $10^8$ Ω.cm or above, the relation between $D_{IN}$ and $D_{OUT}$ is represented by a straight line with a gradient of 1, which means that the picture is free from indistinctness and the dot-copy is reproduced precisely and faithfully.

The image reproducibility is explained for the toner carrying layer 12 of 1 mm thickness in connection with FIG. 4, however, it is more common to express the thickness of the toner carrying layer by an electric thickness $l/\epsilon$ than to express by the physical thickness l. The electric thickness of the toner carrying layer 12 is expressed by $l/\epsilon=5\times10^{-5}$ m.

Figure 5:
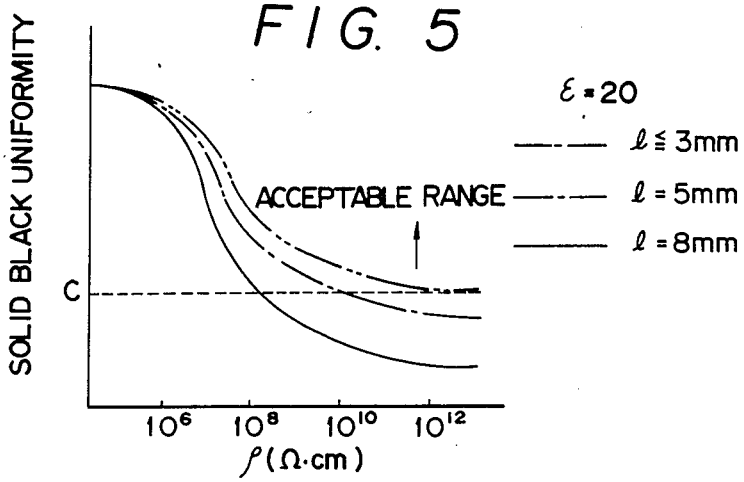
FIG. 5 is a graph showing the variation of the uniformity of solid blacks with the specific resistance of the toner carrying layer for various thickness of the toner carrying layer l.

On the other hand, when the thickness of the toner carrying layer was increased excessively, fringing field of the electrostatic latent image was intensified and the deterioration of uniformity in solid black resulted. This fact will be explained in connection with FIG. 5. When the thickness l of the toner carrying layer was 3 mm or less or $l/\epsilon$ was $1.5\times10^{-4}$ m or below, the uniformity of solid black was acceptable for the specific resistance $\rho$ of the toner carrying layer of $10^6$ to $10^{12}$ Ω.cm (a range above the solid black uniformity C in FIG. 5). When the thickness l of the toner carrying layer was 5 mm or $l/\epsilon$ was $2.5\times10^{-4}$ m, the uniformity of solid black was acceptable for $\rho\leqq10^{10}$ Ω.cm. When l was 8 mm or $l/\epsilon$ was $4.0\times10^{-4}$ m, the uniformity of solid black was acceptable for $\rho\leqq10^8$ Ω.cm.

Thus, it was found from the results of experiments that the appropriate values of the specific resistance $\rho$ of the toner carrying layer and the specific inductive capacity $\epsilon$ for satisfactory dot-copy reproducibility and solid black uniformity were $\rho=10^6$ to $10^{12}$ Ω.cm and $l/\epsilon<4.0\times10^{-4}$ m.

Figure 6:
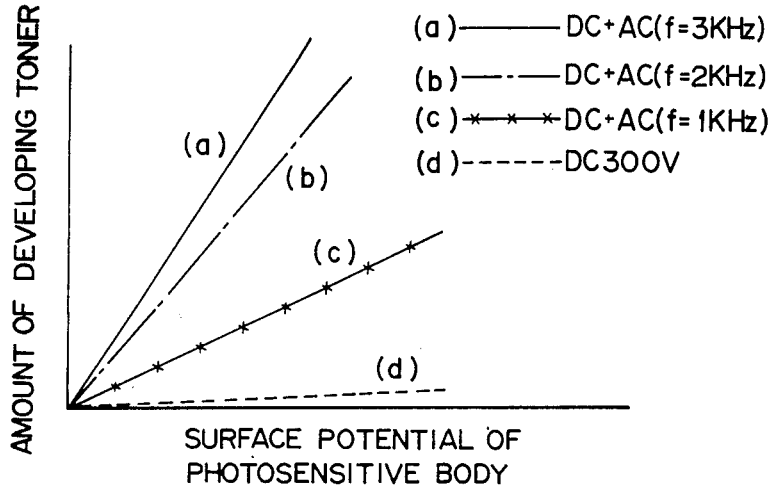
FIG. 6 is a graph showing the variation of the amount of the developing toner with the surface potential of the photosensitive body.

It is a significant feature of the noncontact transfer developing method of the present invention that the electric field produced in the developing gap is produced not only by the electrostatic latent image, but also by an external source of developing electric field. This feature will be described in detail in connection with FIGS. 6 and 7. FIG. 6 is a graph showing the variation of the amount of develping toner with the surface potential of the photosensitive body for various levels of voltage applied to the developing gap, where the developing gap was 150 μ, the specific resistance $\rho$ of the toner carrying layer was $10^{10}$ Ω.cm, the thickness l of the toner carrying layer was 1 mm, the specific inductive capacity $\epsilon$ of the same was 20 and the background potential of the photosensitive body was 250 V. The voltage applied to the develping gap was DC 300 V or DC 300 V+AC 2000 V. The frequency of the alternatig electric field was varied with a range from 1 kHz to 3 kHz.

As apparent from line (d), the toner is unable to fly across the develping gap when only DC bias voltage of 300 V is applied for restricting the flying of the toner to the background section having potential of 250 V. When a high voltage of AC 2000 V was applied in addition to DC bias voltage of 300 V, lines (a), (b) and (c) were obtained. As obvious from FIG. 6, when an AC voltage is applied in addition to the DC voltage, the toner flies across the develping gap according to the potential of the photosensitive body, so that faithful development of the electrostatic latent image is achieved. The $\gamma$ of the developing characteristics is dependent on the frequency of the AC bias voltage applied to the developing gap The toner flies across the develping gap satisfactorily when the frequency is 1 kHz or higher. However, when the frequency of the AC bias voltage is 10 kHz or higher, the transfer of the toner does not charge according to AC bias voltage. Accordingly, the upper limit of the frequency of AC bias voltage is considered to be 10 kHz.

Figure 7:
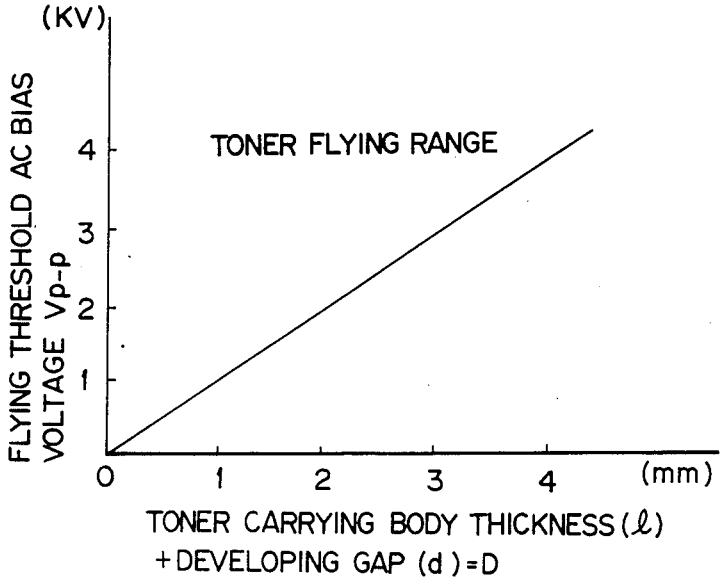
FIG. 7 is a graph showing the relation between the distance D from the developing electrode to the surface of the photosensitive body, i.e., the sum of the thickness l of the toner carrying layer and the size d of the developing gap, and flying threshold AC bias voltage.

FIG. 7 shows the relation between the peak-to-peak voltage $V_{p-p}$ of AC bias voltage necessary for separating the toner from the toner carrying layer and making the separated toner fly toward the photosensitive body and the sum of the thickness l of the toner carrying layer and the size d of the developing gap, where the specific resistance $\rho$ of the toner carrying layer was $10^{10}$ Ω.cm, the specific inductive capacity $\epsilon$ was 20, the background potential of the photosensitive body was 250 V and the frequency of the AC bias voltage was 2 kHz. As apparent from FIG. 7, when the thickness l of the toner carrying layer was 20 μm ($l/\epsilon = 1\times10^{-6}$ m) and the size d of the developing gap was 80 μm, for instance, the peak-to-peak voltage $v_{p-p}$ of AC bias voltage necessary to make the toner start flying was 400 V or higher. When l+d was 1 mm, the necessary $V_{p-p}$ was 1000 V or higher and when l+d was 3 mm, the necessary $V_{p-p}$ was 3000 V or higher. The necessary $V_{p-p}$ is dependent also on the specific resistance $\rho$ and the specific inductive capacity of the toner carrying layer and the frequency f of the AC bias voltage. Ordinarily, the toner can be made to fly surely when 400 V $\leqq V_{p-p} \leqq$ 4500 V, desirably, when $800 \leqq V_{p-p} \leqq 2500$ V.

Figure 8:
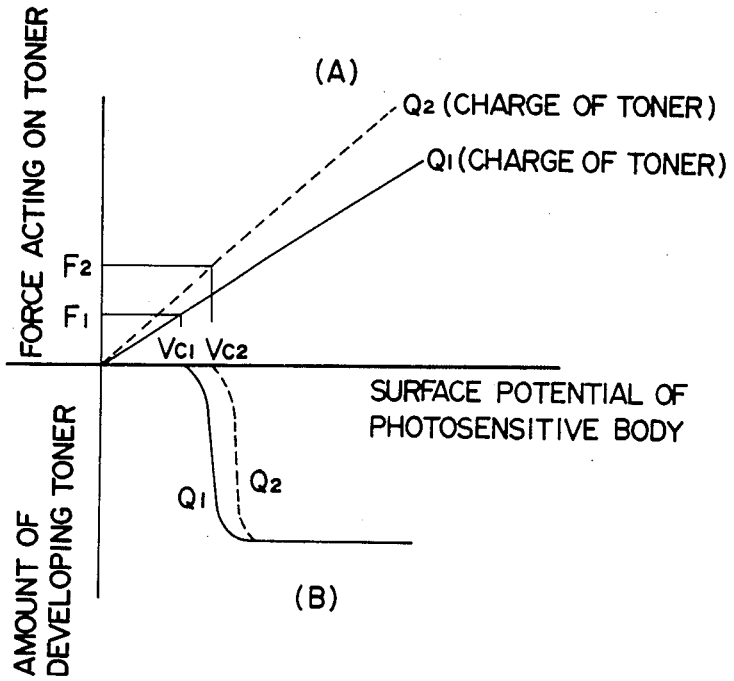
FIG. 8A is a graph showing the variation of force acting on the toner with the surface potential of the photosensitive body.
FIG. 8B is a graph showing the variation of the amount of the developing toner with the surface potential of the photosensitive body.

Another feature of the present invention, namely, improving tone gradation reproducibility by expanding the range of distribution of the charges of toner particles, will be described hereinafter. FIG. 8A is a graph showing the variation of force acting on the toner with the surface potential of the photosensitive body for charges of toner. FIG. 8B is a graph showing the variation of the amount of developing toner with the surface potential of the photosensitive body for charges of toner. In FIGS. 8A and 8B, the axis of abscissa represents the surface potential of the photosensitive body and the axis of ordinate represents the force acting on toner and the amount of developing toner, respectively. The disadvantage of the conventional noncontact transfer developing method as disclosed in U.S. Pat. No. 3,866,574, the critical developing characteristics of high gammma value, will be explained in connection with FIGS. 8A and 8B.

When the charge of the toner is $Q_1$ and the surface potential of the photosensitive body is V, electric force that acts on the toner is proportional to $Q_1 \times V$. On the other hand, the force that attracts the toner to the toner carrying layer (a force that acts in a direction opposite to the developing direction, i.e., a resistance to development) is proportional to the square of the charge $Q_1$ of the toner. At a surface potential exceeding a surface potential threshold ($V_c$) at which the electric force that acts on the toner and the force attracting the toner to the toner carrying layer balance, the toner starts flying equally for those surface potentials exceeding the surface potential threshold $V_c$, and hence sharp developing characteristics of a large gamma value is exhibited. In FIG. 8A, suppose that the force attracting the toner having a charge $Q_1$ is $F_1$ and the surface potential threshold is $V_{c1}$. Then, the toner starts flying when the surface potential is higher than $V_{c1}$. Therefore, the surface potential threshold $V_{c2}$ for toner having a charge $Q_2$ which is greater than $Q_1$ is higher than $V_{c1}$. Since the distribution of the charge Q of a conventional single-component developer has a relatively narrow range, the critical developing characteristics having a large gamma value has been unavoidable.

The developing method disclosed in the above-mentioned Japanese Patent Publication No. Sho 58-32375, in which the transfer of toner from the toner carrying body to the photosensitive body and the reverse transfer of the the toner from the photosensitive body to the toner carrying body are repeated alternately by the agency of a low-frequency alternating electric field, is a well-known method for improving such critical developing characterisitcs, namely, for improving the half-tone gradation of an image to be reproduced. According to the present invention, the developing electric field is controlled by the resistance, thickness and the dielectric constant of the toner carrying layer and the size of the developing gap, therefore a high-frequency alternating electric field needs to be used and well-known means are incapable of improving the toner gradation reproducibility.

Figure 9:
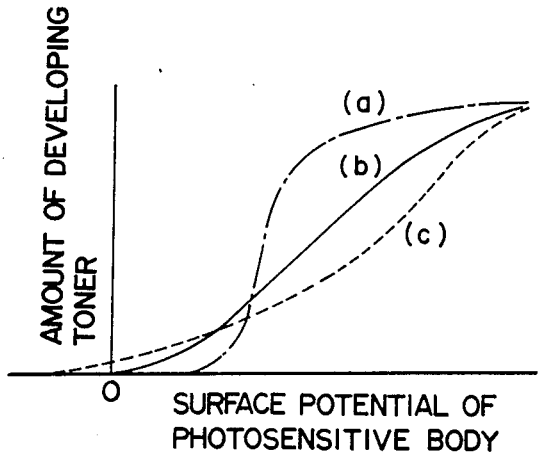
FIG. 9 is a graph showing the variation of the amount of the developing toner with the surface potential of the photosensitive body for various charges of the toner.

Accordingly, the present invention intends to improve critical developing characteristics through the expansion of the range of the surface potential threshold $V_c$ by employing a toner having particles of different charges. FIG. 9 is a graph showing the variation of the amount of toner with the surface potential of the photosensitive body, in which a curve (a) is a developing characteristics curve for a developing process using a toner having particles of charges distributing over a range of ±3 μc/g about the means charge Q. The curve (a) represents a developing characteristics of a large gamma value. A curve (b) is a developing characteristics curve for a developing process using a toner having particles of charges distributing over a range of ±15 μc/g, which shows excellent tone gradation reproducibility.

A curve (c) is for developing process using a toner having particles of charges distributing over a range of ±20 μc/g, in which the range of development starting potential is expanded as far as a negative voltage, which caused fogging in the background, and hence this toner is not applicable. Such fogging is caused (the cause will be explained as regards a developing process using a photosensitive body of positive polarity for convenience' sake) by the toner of the reverse polarity (positive polarity). It was found through experiments that toner particles, including reverse polarity, of more than less than +10 μc/g did not cause significant fogging in the background, whereas toner particles of +10 μc/g caused fogging of unacceptable level. Accordingly, in the present invention, the desireable range of distribution of charges of toner particles is ±15 μc/g about the mean value.

EXAMPLE

An exemplary application of the noncontact transfer developing method of the present invention to a developing process using a nonmagnetic toner will be described hereinafter.

A toner carrying body employed is of 20 mm diameter, $10^{10}$ Ω.cm specific resistance $\rho$, 1 mm thickness l and 20 specific inductive capacity $\epsilon$ and provided with an electrode on the backside.

Figure 10:
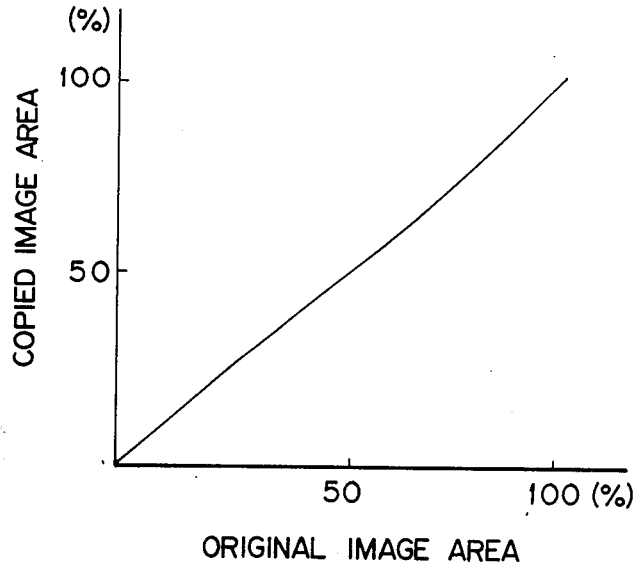
FIG. 10 is a graph showing the dot-copy reproducibility of an embodiment of the present invention.

A toner layer was formed by means of a well-known blade over the surface of the toner carrying body and the toner carrying body was charged in a well-known manner. The toner was held on the toner carrying body by mirror force or by Van der Waals' forces and carried to the developing zone. The range of distribution of the charges Q of the toner particles was as wide as $-5\ \mu c/g \leqq Q \leqq +25\ \mu c/g$. The size d of the developing gap was fixed at 200 μm. A high-frequency alternating electric field was formed in the developing gap by an AC bias voltage of 2500 V $V_{p-p}$ and 1.5 kHz frequency. The potentials of the latent image were 800 V dark potential $V_D$ for the image section and 250 V background potential $V_B$ for the background. DC 350 V was applied as a background control bias. The results of the copying operation showed, as seen in FIG. 10, an ideal dot-copy reproducibility of approximately 1 to 1 correspondence of the original image input area and the copied image area.

What is claimed is:

1. In a non-contact developing method of developing an electrostatic latent image with toner particles, comprising disposing a development electrode with a gap opposite to a latent image bearing member, said development electrode carrying toner particles layered thereon and said latent image bearing member having a conductive substrate backing-up thereto, and allowing the toner particles on said development electrode to move across said gap from said development electrode to said latent image bearing member to thereby develop the latent image with the toner particles, the improvement comprising:

forming a toner carrying layer having a specific resistance of $10^6$ to $10^{12}$ Ω.cm on said development electrode opposite to said latent image bearing member, said toner carrying layer being formed of a resistive material and having the characteristics defined by $l/\epsilon < 4 \times 10^{-4}$ m where l and $\epsilon$ are respectively, the thickness in meters and the specific inductive capacity of the toner carrying layer; and applying a high-frequency alternating electric field, having a frequency of about 1 to 10 kHz and $V_{p-p}$ of about 400 to 4500 V between said development electrode and said conductive substrate thereby forming a fringing field in a latent image portion of said latent image bearing member whereby the electrostatic latent image is developed with the toner particles in accordance with a pattern of the electrostatic latent image, and wherein the range of the distribution of individual charges of the toner particles is within ±15 μc/g from the mean charge thereof.

2. A developing method according to claim 1, wherein the frequency of the high-frequency electric field to be applied between the development electrode and the conductive substrate is about 1 to 3 kHz and $V_{p-p}$ is about 800 to 2500 V.

3. In a non-contact developing method according to claim 1, the improvement further comprising the application of a direct current background control bias.

4. In a non-contact developing method according to claim 1, the improvement further comprising maintaining a distance greater than 0.5 mm between the development electrode and the photosensitive body.

5. In a non-contact developing method according to claim 1, the improvement further comprising maintaining a distance greater than 1 mm between the development electrode and the photosensitive body.

* * * * *